US005714444A

United States Patent [19]

Yokouchi et al.

[11] Patent Number: 5,714,444

[45] Date of Patent: Feb. 3, 1998

[54] GREASE COMPOSITION

[75] Inventors: Atsushi Yokouchi; Masao Yamamoto; Atsuhiro Yamamoto; Michiharu Naka, all of Kanagawa, Japan

[73] Assignee: NSK Ltd., Tokyo, Japan

[21] Appl. No.: 559,088

[22] Filed: Nov. 17, 1995

[30] Foreign Application Priority Data

Nov. 18, 1994 [JP] Japan ..... 6-308444

[51] Int. Cl.[6] ..... C10M 117/00; C10M 169/02

[52] U.S. Cl. ..... 508/539; 508/463; 508/465

[58] Field of Search ..... 508/539

[56] References Cited

U.S. PATENT DOCUMENTS

| | | | |
|---|---|---|---|
| 2,861,950 | 11/1958 | Renshaw | 508/539 |
| 2,883,341 | 4/1959 | Allison | 508/539 |
| 2,990,345 | 6/1961 | Natkin et al. | 508/539 |
| 3,980,572 | 9/1976 | Dodo et al. | 508/539 |
| 4,582,616 | 4/1986 | Kita et al. | 508/539 |
| 4,749,502 | 6/1988 | Alexander et al. | 508/539 |
| 5,236,607 | 8/1993 | Harris et al. | 508/539 |

FOREIGN PATENT DOCUMENTS

| | | | |
|---|---|---|---|
| 2278612 | 7/1994 | United Kingdom | C10M 117/04 |

*Primary Examiner*—Ellen M. McAvoy

*Attorney, Agent, or Firm*—Sughrue, Mion, Zinn, Macpeak & Seas, PLLC

[57] ABSTRACT

A grease composition comprising a base oil and a thickener, in which the thickener comprises a lithium soap of $C_{12}$–$C_{24}$ fatty acid containing no hydroxyl group and a lithium soap of $C_{12}$–$C_{24}$ fatty acid containing a hydroxyl group and the base oil has kinematic viscosity of 25 to 200 $mm^2$/sec at 40° C. and contains 10 to 70% by weight of an ester oil, the grease composition containing from 20 to 30% by weight of the two specific thickeners. Prolonged continuous operation of bearings into which the grease composition is sealed does not cause an amount of splashing grease to increase and noiseless property to be deteriorated.

2 Claims, 2 Drawing Sheets

GREASE COMPOSITION

FIELD OF THE INVENTION

The present invention relates to a grease composition for bearings, linear guides and ball screws used for electronic computers, production units of semiconductor, and so forth, which require low dusting characteristics. Particularly, it relates to a grease composition which can control an amount of splashing grease over a long period of time, in addition to improvement in frictional torque performance and in noiseless property.

BACKGROUND OF THE INVENTION

Performances required by bearings, linear guides and ball screws used for electronic computers, production units of semiconductor and so forth are low torque and excellent noiseless property. Among them, one of the most required performances is the performance to control an amount of grease splashing from bearings (hereinafter occasionally abbreviated as a "splashing amount") and the durability to maintain the performance over a long period of time. The reason for this is that errors caused by contaminating recording media with the splashing grease must be avoided.

A soap-type grease which is well known as "Andok C" (trade name, a grease of sodium complex soap-mineral oil type which contains a mineral oil as a base oil and sodium complex soap as a thickener) has been almost exclusively employed for more than 20 years, because of a small amount of splashing grease (hereinafter referred to as "anti-splashing property").

As the latest typical prior art, a grease composition for the electronic computers which has excellent anti-splashing property at ordinary temperature has been described in JP-A-5-9489 (The term "JP-A" as used herein means an "unexamined published Japanese patent application"). The grease composition contains 70 to 80% by weight of a base oil comprising at least one selected from the group consisting of mineral oils, synthetic hydrocarbon oils and polyphenyl ether oils which have kinematic viscosity of 8 to 180 $mm^2$/sec at 40° C., 20 to 30% by weight of a lithium soap of $C_{12}$–$C_{24}$ fatty acid containing no hydroxyl group in the chemical formula, and a particular antirust additive.

However, in the grease of sodium complex soap-mineral oil type, the soap has poor dispersibility into the grease to be hard to form a uniform state, which causes poor noiseless property and vibration-controlling performance at the beginning of rotation of bearings. Further, the soap has so strong water absorption property that the grease hardens with time, which deteriorates fluidity thereof in the bearings to cause insufficient lubricity. As a result, the grease has the disadvantage of often producing an abnormal sound from the cage of the bearings.

Therefore, particularly when low sound and low vibration are required, a low-sound, low-torque grease has been used, which typically contains lithium soap as a thickener and an ester oil as a base oil. However, when the grease of lithium soap-ester oil type itself is used, it is liable to splash and has a danger of soiling the recording media. To inhibit the splashing, the grease is occasionally used together with a magnetic fluid seal. However, the magnetic fluid seal is expensive to increase the cost of products and, in addition, requires some mounting space therefor, which prevents the products from being miniaturized.

Although the grease of the above-mentioned JP-A-5-9489 has excellent initial anti-splashing property, the splashing amount thereof increases at higher temperatures of about 70° C. which is the highest operating temperature of the bearings used for the electronic computers, and prolonged continuous operation deteriorates the noiseless property of the bearings (hereinafter occasionally referred to as "durability of noiseless property"). Further, although the grease described in British Patent 2,278,612 can control splashing amounts at room temperature and at 70° C., it fails to afford a desired result as to durability of noiseless property and has the disadvantage of increasing the splashing amount with time as well.

SUMMARY OF THE INVENTION

An object of the present invention is to solve the above-mentioned technical problems and to provide a grease composition having excellent durability such that it neither increases the splashing amount nor deteriorates the noiseless property of a bearing, and can keep low dusting characteristics restraining a change of such a performance over a lapse of time even during prolonged continuous operation.

The present invention provides a grease composition comprising a base oil and a thickener, wherein the thickener comprises a lithium soap of $C_{12}$–$C_{24}$ fatty acid containing no hydroxyl group (hereinafter referred to as lithium soap A) and a lithium soap of $C_{12}$–$C_{24}$ fatty acid containing a hydroxyl group (hereinafter referred to as lithium soap B), and the base oil has a kinematic viscosity of 25 to 200 $mm^2$/sec at 40° C. and contains an ester oil in an amount of 10 to 70% by weight based on the amount of the base oil, the grease composition containing the lithium soaps A and B in a total amount of 20 to 30% by weight based on the amount of the grease composition.

DETAILED DESCRIPTION OF THE INVENTION

Figure 1:
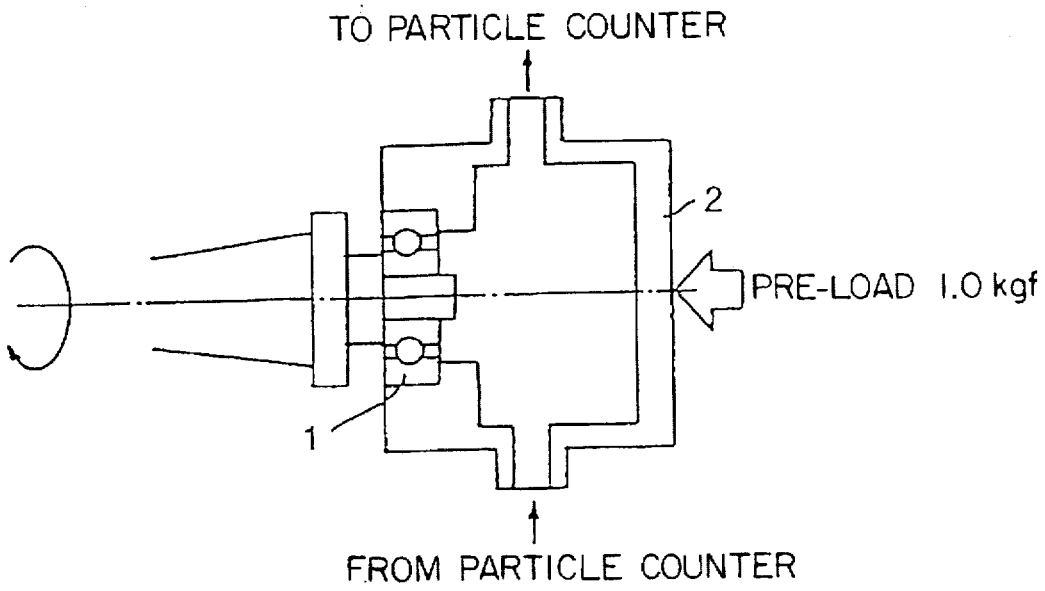
FIG. 1 shows an outline of a device for measuring the splashing amount.

The grease composition of the present invention will be described in more detail below.

The base oil to be used for the grease composition of the present invention contains an ester oil in an amount of 10 to 70% by weight, preferably from 15 to 65% by weight, based on the base oil. The ester oils are not particularly limited, but preferred examples of the ester oil include diester oils obtained by the reaction between a dibasic acid and a branched alcohol; aromatic ester oils obtained by the reaction between an aromatic tribasic acid and a branched alcohol; and hindered ester oils obtained by the reaction between a polyhydric alcohol and a monobasic acid. From the viewpoint of heat resistance (in the case where the grease composition is used under a high temperature and high speed condition), it is preferred that the ester oil is at least one selected from aromatic ester oils and hindered ester oils and used singly or an admixture thereof.

Examples of the diester oil include dioctyl adipate (DOA), diisobutyl adipate (DIBA), dibutyl adipate (DBA), dioctyl azelate (DOZ), dibutyl sebacate (DBS), dioctyl sebacate (DOS), and methyl acetylricinoleate (MAR-N).

Examples of the aromatic ester oil include trioctyl trimellitate (TOTM), tridecyl trimellitate, and tetraoctyl pyromellitate.

Examples of the polyhydric alcohol which can be used for the preparation of the hindered ester oil include trimethylolpropane (TMP), pentaerythritol (PE), dipentaerythritol (DPE), neopentyl glycol (NPG), and 2-methyl-2-propyl-1, 3-propanediol (MPPD).

Examples of the monobasic acid which can be used for the preparation of the hindered ester oils typically include fatty acids having 4 to 18 carbon atoms, such as butyric acid, valeric acid, caproic acid, caprylic acid, enanthic acid, pelargonic acid, capric acid, undecanoic acid, lauric acid, myristic acid, palmitic acid, beef tallow fatty acid, stearic acid, caproleic acid, undecylenic acid, linderic acid, tsuzuic acid, physeteric acid, myristoleic acid, palmitoleic acid, petroselinic acid, oleic acid, elaidic acid, asclepinic acid, vaccenic acid, sorbic acid, linoleic acid, linolenic acid, sabinic acid, and ricinoleic acid. The monobasic acid may be used either individually or as a combination of two or more thereof.

Complex esters which are oligo esters between a polyhydric alcohol and a dibasic acid-monobasic acid mixed fatty acid may also be used.

Other components than the ester oil in the base oil to be used for the grease composition of the present invention Components other than the ester oil constituting the base oil are not particularly limited. Examples thereof include mineral oils, synthetic hydrocarbon oils and ether oils.

Preferred examples of the mineral oil are highly purified oils stemming from petroleum, which include naphthene base and paraffin base. The viscosity index of these oils is not particularly limited.

Examples of the synthetic hydrocarbon oil include poly-α-olefin oils and synthetic co-oligomer oils prepared from α-olefin and ethylene.

Examples of the ether oil include a phenyl ether oil comprising a diphenyl group, a triphenyl group or a tetraphenyl group each having one or two alkyl chains having $C_{12}$ to $C_{20}$ as substituent(s). Particularly, in view of resistance to high temperature and to high speed, such a (di)alkyl polyphenyl ether oil is preferably used.

The base oil to be used for the composition of the present invention has a kinematic viscosity at 40° C. of from 25 to 200 $mm^2$/sec, and preferably from 40 to 180 $mm^2$/sec.

The grease composition of the present invention contains 20 to 30% by weight of lithium soaps of $C_{12}$–$C_{24}$ higher fatty acid which have good dispersibility and provide good noiseless property. It is preferred that the proportion by weight of lithium soap A and lithium soap B is 60:40 to 90:10. When lithium soap A and lithium soap B are pertinently selected and mixed in the proportion falling within the above range, the thickener can fairly reduce the splashing amount of grease at higher temperatures. Too large proportion of lithium soap B to lithium soap A causes the splashing amount to fairly increase, particularly at higher temperatures.

Lithium soap A is not particularly limited, and examples thereof include lithium laurate ($C_{12}$), lithium myristate ($C_{14}$), lithium palmitate ($C_{16}$), lithium margarate ($C_{17}$), lithium stearate ($C_{18}$), lithium arachidate ($C_{20}$), lithium behenate ($C_{22}$), lithium lignocerate ($C_{24}$), and lithium soap of beef tallow fatty acid. Among them, lithium stearate and lithium soap of beef tallow fatty acid are preferably used. Lithium soap B also is not particularly limited, and examples thereof include lithium 9-hydroxystearate, lithium 10-hydroxystearate, lithium 12-hydroxystearate, lithium 9,10-dihydroxystearate, lithium ricinoleate, and lithium ricinoelaidate. Among them, lithium 12-hydroxystearate is preferably used.

Lithium soap A and lithium soap B may be composed of one kind of the soaps or may be composed of two or more kinds of the soaps, respectively. Other substances than lithium soap A and lithium soap B can be suitably added as a thickener, as long as the substances do not deteriorate the characteristics of the grease composition of the present invention.

The grease composition of the present invention comprises the base oil and the thickener. Further, antirust additives, anti-oxidants, and others also can be added to the grease composition, as long as they do not deteriorate the characteristics of the grease composition.

A grease having an appropriate hardness is necessary to improve the anti-splashing property, because the splashing of grease stems from fine particles of the grease formed by rotation of bearings. However, too firm grease lowers its fluidity inside the bearings to cause sound to emanate from the cage of the bearings. That is, the hardness of grease is a factor closely referring to the anti-splashing property and to the noiseless property. Hence, the present inventors have also studied the penetration of grease compositions. As a result, it has been found that the unworked penetration preferably ranges from 190 to 250. The unworked penetration not exceeding 190 results in too firm grease and fairly deteriorates the noiseless property and the torque performance. On the other hand, the unworked penetration exceeding 250 increases the splashing amount to cause the recording media of electronic computers to be contaminated. The penetration is adjusted with a three-roll mill (toward decrease in penetration) or a kneader (toward increase in penetration) at the final step of a manufacturing process.

The ester oils have a good affinity to metals, high capability in retaining oil film, and excellent oil lubricity (the effect of oiliness) because of the presence of its ester bond.

The features of the present invention reside in that the effect of oiliness of the ester oil improves durability, lubricity, and heat resistance and the components are blended such that low dusting characteristics are maintained.

In the present invention, although the addition of the ester oil slightly increases the initial splashing amount of grease, it extremely decreases changes of splashing amount, noiseless property and durability with time.

When the respective components of the grease composition do not fall within the ranges determined by the present invention, the grease composition has the following drawbacks.

If the total content of lithium soaps A and B is less than 20% by weight, the initial splashing amount at higher temperatures (about 70° C.) would be increased, and if it exceeds 30% by weight, the initial noiseless property of bearings would be deteriorated and the torque would be increased.

If the proportion of lithium soap A to lithium soap B is outside the range determined by the present invention, the initial splashing amount at higher temperatures would be increased, and particularly, high proportion of lithium soap B to lithium soap A would increase the splashing amount even at room temperature.

If the content of the ester oil in the base oil is less than 10% by weight, the grease composition would have insufficient durability of noiseless property, and if it exceeds 70% by weight, the initial splashing amount would be increased.

If the viscosity of the base oil is less than 25 $mm^2$/sec, good initial characteristics (the splashing amount and noiseless property of the bearings) and satisfactory durability of noiseless property would be exhibited, but the splashing amount would be increased with time. If the viscosity exceeds 200 $mm^2$/sec, the initial torque would be increased.

The present invention is illustrated with reference to the following examples in more detail. However, the examples are not to be construed as limiting the present invention.

EXAMPLES AND COMPARATIVE EXAMPLES

Grease compositions were prepared by blending the thickener and the base oil as shown in Tables 1 to 4.

As to Examples 1 to 15 and Comparative Examples 1 to 19, the compositions and the results of measurement of penetration, initial splashing property, initial noiseless property of bearings and initial torque are shown in Tables 1 to 4. Further, as to Examples 1 to 9, and Comparative Examples 6, 9, 11 to 15, and 18 which exhibited good initial characteristics, the durability was determined (duration for which the corresponding bearings maintain noiseless property and a splashing amount at the end of test).

UnWorked Penetration and Worked Penetration

The unworked penetration and worked penetration were measured according to JIS K2220 (5.3).

Splashing Amount, Noiseless Property and Torque

To determine the splashing amount, noiseless property and torque, 19 mg of each grease composition to be tested was sealed into a single-line deep groove ball bearing having an inner diameter of 5 mm and an outer diameter of 13 mm fitted with a non-contact rubber seal which had been completely degreased with an organic solvent, and was preloaded to 1.5 kgf. The measurements of these properties were made at ordinary temperature (about 25° C.) and at 70° C. only for the determination of the splashing amount.

The outline of a device for measuring the splashing amount is shown in FIG. 1. By the use of this device, in which bearings to be tested 1 are fitted to vessel 2 having an air inlet and an air outlet and rotated by a motor which is set outside the device and not illustrated in the figure, grease particles splashing within vessel 2 are measured with a particle counter which is not illustrated in the figure. Clean air is permitted to pass through vessel 2 of the device which is allowed to stand at room temperature or at 70° C., while rotating bearings 1 at 3,600 rpm for 20 minutes into which a grease composition is sealed, and a number of splashing particles having a size of 0.3 μm or larger which are contained in every 0.01 cubic feet of air is counted by the particle counter. The splashing amount was determined in 20 minutes after the bearing starts rotating. The results are shown in Tables 1 to 4.

The noiseless property of the bearing was judged by Anderon value which was measured with an Anderon meter, while rotating the bearings to be tested at 1,800 rpm. As a result of judgement, Anderon values of 2 or less are shown by "A, whereas the values of 2 or higher are shown by "B".

Figure 2:
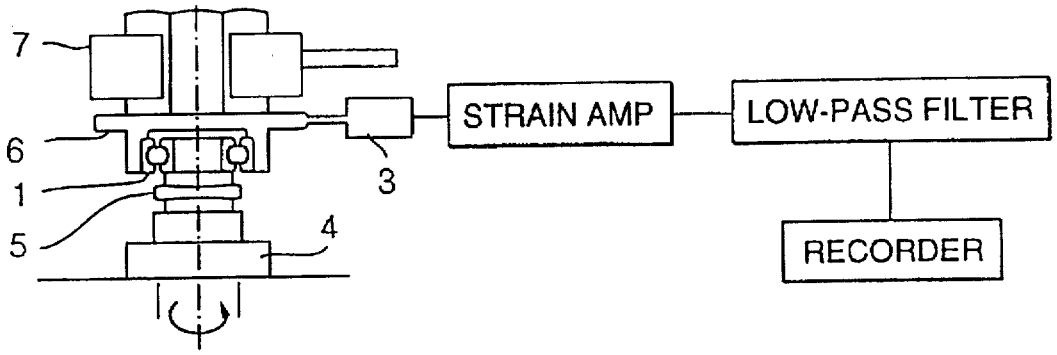
FIG. 2 shows an outline of a device for measuring the torque.

The outline of a device for measuring torque is shown in FIG. 2. Torque value was measured with strain gauge 3, while rotating a bearing to be tested A at 3,600 rpm, and was recorded. The torque value which was almost stabilized in ten minutes after the bearing starts rotating is shown in Tables 1 to 4. In FIG. 2, 4 shows an air spindle, 5 an arbor, 6 an aluminum cap, and 7 an air bearing. Measured values which are 3 kgf·cm or less are shown by "A", whereas the values exceeding 3 kgf·cm are shown by "B".

Durability Test

Figure 3:
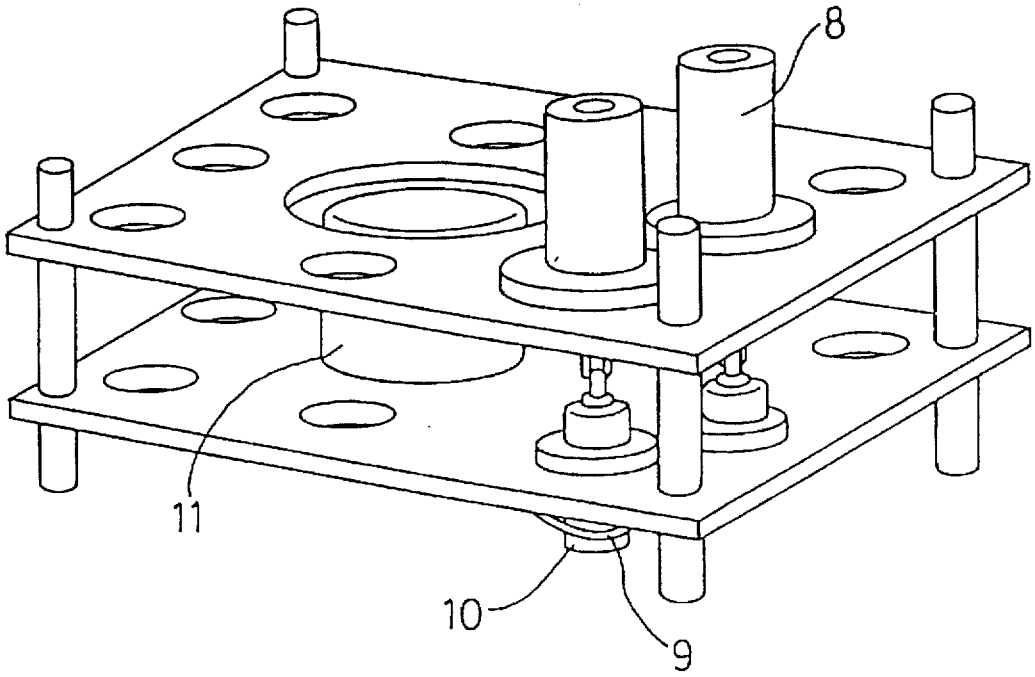
FIG. 3 is a bird's-eye view of a device for continuously rotating bearings.
Figure 4:
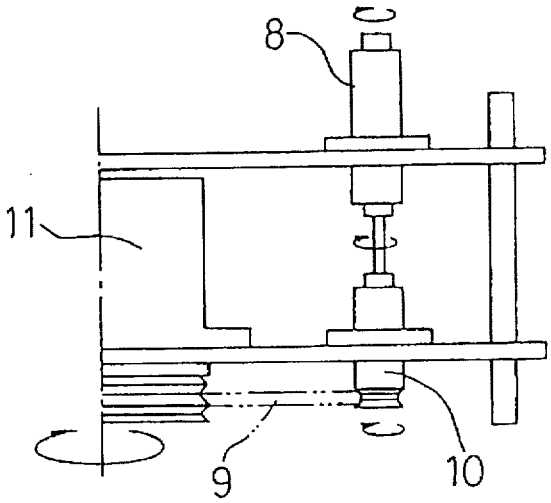
FIG. 4 is a cross-sectional view of a device for continuously rotating bearings.

The outlines of an continuous rotating device for durability test are shown in FIG. 3 and 4. In this device, the bearing to be tested placed in housing 8 is rotated by motor 11 via rubber belt 9 and pulley 10.

By the use of this device, the bearings to be tested were continuously rotated at 70° C. at 3,600 rpm. The noiseless property was measured in every 500 hours up to 3,000 hours and the time in which Anderon value exceeded 2 was examined. The splashing amount at 70° C. was determined at the end of this test.

As to the grease compositions of the examples and comparative examples, results of measurements of the above-mentioned properties are shown in Tables 1 to 4.

Comparing Examples with Comparative Examples 1, 2 and 16, it can be seen that when the content of the thickener did not exceed 15% by weight, the initial splashing amount was increased, and when it was 40% by weight, the initial noiseless property was deteriorated and the torque was increased.

Comparing Examples with Comparative Examples 3, 4 and 5, it can be seen that when the content of lithium 12-hydroxystearate, a thickener, was 0% by weight and 70% by weight or more, the initial splashing amount at 70° C. was increased, and particularly, when it was 100% by weight, the initial splashing amount was increased even at room temperature.

Comparing Examples with Comparative Examples 6 to 8 and 11 to 15, it can be seen that, when the content of the ester oil in the base oil was 80% by weight or more, the initial splashing amount at 70° C. significantly was increased, and particularly, when the content of the ester oil was 100% by weight, the initial splashing amount was increased even at room temperature, and that, when the content of the ester oil was 0% by weight, the duration for which the noiseless property was maintained is 2,000 hours or less, although the initial performances were satisfactory.

Comparing Examples with Comparative Examples 9, 10 and 18, it can be seen that, when the viscosity of the base oil was 20 $mm^2$/sec, the splashing amount was increased at 70° C. after the bearing was rotated for 3,000 hours, although the initial performance was good and the duration for which the noiseless property was maintained.

Comparing Examples 1 to 9 with Comparative Examples 11 to 15, it can be seen that although the grease compositions containing no ester oil were advantageous in the initial splashing amount (both at 70° C. and at room temperature), the grease compositions had short duration and their splashing amounts increased with time.

Comparing Examples with Comparative Examples 17 and 19, it can be seen that, when the unworked penetration was 180, the initial noiseless property was deteriorated and the initial torque also often increased, and that, when the unworked penetration was 270, the initial splashing amount at 70° C. often increased (The initial splashing amount also slightly increased even at room temperature).

TABLE 1

| | Example | | | | | | |
|---|---|---|---|---|---|---|---|
| | 1 | 2 | 3 | 4 | 5 | 6 | 7 |
| Thickener | | | | | | | |
| Lithium Stearate (A) (g) | 175 | 210 | 225 | 150 | 175 | 175 | 175 |
| Lithium 12-Hydroxy-stearate (B) (g) | 75 | 90 | 25 | 100 | 75 | 75 | 75 |
| Proportion (A:B) | 7:3 | 7:3 | 9:1 | 6:4 | 7:3 | 7:3 | 7:3 |
| Base Oil | | | | | | | |
| Ester Oil (g) | 260 | 245 | 260 | 260 | 110 | 490 | 300 |
| Poly-α-olefin (g) | 490 | 455 | 490 | 490 | 640 | 260 | 450 |
| Mineral Oil (g) | — | — | — | — | — | — | — |
| Ester Oil Content of Base Oil (%) | 35 | 35 | 35 | 35 | 15 | 65 | 40 |
| Thickener Content of Grease (%) | 25 | 30 | 25 | 25 | 25 | 25 | 25 |
| Viscosity of Base Oil ($mm^2$/sec, 40° C.) | 70 | 70 | 70 | 70 | 56 | 90 | 42 |
| Initial Charateristics | | | | | | | |
| Unworked Penetration | 214 | 211 | 223 | 208 | 219 | 225 | 218 |
| Worked Penetration | 219 | 216 | 226 | 211 | 227 | 230 | 235 |
| Number of Splashing Particles having a Size of 0.3 μm or Larger (number/0.01 cf) | | | | | | | |
| 25° C. | 600 | 650 | 700 | 1050 | 650 | 500 | 700 |
| 70° C. | 2600 | 2900 | 3950 | 3100 | 1900 | 2050 | 3000 |
| Initial Noiseless Property | A | A | A | A | A | A | A |
| Initial Torque (gf · cm) | A | A | A | A | A | A | A |
| Durability | | | | | | | |
| Duration for which Noiseless Property is Maintained (hour) | >3000 | >3000 | >3000 | >3000 | >3000 | >3000 | >3000 |
| Dusting Characteristics at 70° C. (number/0.01 cf) | 3800 | 4050 | 4800 | 3950 | 2850 | 3000 | 4200 |

TABLE 2

| | Example | | | | | | | |
|---|---|---|---|---|---|---|---|---|
| | 8 | 9 | 10 | 11 | 12 | 13 | 14 | 15 |
| Thickener | | | | | | | | |
| Lithium Stearate (A) (g) | 175 | 210 | 140 | 120 | 270 | 225 | 180 | 180 |
| Lithium 12-Hydroxy-Stearate (B) (g) | 75 | 90 | 60 | 80 | 30 | 25 | 20 | 120 |
| Proportion (A:B) | 7:3 | 7:3 | 7:3 | 6:4 | 9:1 | 9:1 | 9:1 | 6:4 |
| Base Oil | | | | | | | | |
| Ester Oil (g) | 300 | 100 | 320 | 120 | 455 | 300 | 520 | 245 |
| Poly-α-olefin (g) | — | 600 | 480 | 680 | 245 | — | 280 | 455 |
| Mineral Oil (g) | 450 | — | — | — | — | 450 | — | — |
| Ester Oil Content of Base Oil (%) | 40 | 15 | 40 | 15 | 65 | 40 | 65 | 35 |
| Thickener Content of Grease (%) | 25 | 30 | 20 | 20 | 30 | 25 | 20 | 30 |
| Viscosity of Base Oil ($mm^2$/sec, 40° C. | 180 | 54 | 42 | 56 | 90 | 180 | 90 | 70 |
| Initial Charateristics | | | | | | | | |
| Unworked Penetration | 220 | 224 | 231 | 228 | 218 | 236 | 233 | 205 |
| Worked Penetration | 241 | 229 | 235 | 232 | 222 | 240 | 236 | 209 |
| Number of Splashing Particles having a Size | | | | | | | | |

TABLE 2-continued

| | Example | | | | | | | |
|---|---|---|---|---|---|---|---|---|
| | 8 | 9 | 10 | 11 | 12 | 13 | 14 | 15 |
| of 0.3 μm or Larger (number/0.01 cf) | | | | | | | | |
| 25° C. | 750 | 650 | 900 | 800 | 650 | 800 | 850 | 950 |
| 70° C. | 900 | 2050 | 2350 | 3300 | 3650 | 3450 | 3800 | 3200 |
| Initial Noiseless Property | A | A | A | A | A | A | A | A |
| Initial Torque (gf · cm) | A | A | A | A | A | A | A | A |
| Durability | | | | | | | | |
| Duration for which Noiseless Property is Maintained (hour) | >3000 | >3000 | — | — | — | — | — | — |
| Dusting Characteristics at 70° C. (number/0.01 cf) | 3900 | 3600 | — | — | — | — | — | — |

TABLE 3

| | Comparative Example | | | | | | | | | |
|---|---|---|---|---|---|---|---|---|---|---|
| | 1 | 2 | 3 | 4 | 5 | 6 | 7 | 8 | 9 | 10 |
| Thickener | | | | | | | | | | |
| Lithium Stearate (A) (g) | 70 | 280 | 250 | 75 | — | 175 | 175 | 175 | 175 | 175 |
| Lithium 12-Hydroxystearate (B) (g) | 30 | 120 | — | 175 | 250 | 75 | 75 | 75 | 75 | 75 |
| Proportion (A:B) | 7:3 | 7:3 | 10:0 | 3:7 | 0:10 | 7:3 | 7:3 | 7:3 | 7:3 | 7:3 |
| Base Oil | | | | | | | | | | |
| Ester Oil (g) | 320 | 210 | 260 | 260 | 260 | — | 600 | 750 | 450 | 490 |
| Poly-α-olefin (g) | 580 | 390 | 490 | 490 | 490 | 750 | 150 | — | — | — |
| Mineral Oil (g) | — | — | — | — | — | — | — | — | 300 | 260 |
| Ester Oil Content of Base Oil (%) | 35 | 35 | 35 | 35 | 35 | 0 | 80 | 100 | 60 | 65 |
| Thickener Content of Grease (%) | 10 | 40 | 25 | 25 | 25 | 25 | 25 | 25 | 25 | 25 |
| Viscosity of Base Oil ($mm^2$/sec, 40° C. | 70 | 70 | 70 | 70 | 70 | 48 | 98 | 120 | 20 | 250 |
| Initial Charateristics | | | | | | | | | | |
| Unworked Penetration | 256 | 195 | 220 | 201 | 210 | 233 | 218 | 223 | 210 | 223 |
| Worked Penetration | 262 | 206 | 227 | 206 | 214 | 238 | 224 | 230 | 222 | 232 |
| Number of Splashing Particles having a Size of 0.3 μm or Larger (number/0.01 cf) | | | | | | | | | | |
| 25° C. | 1200 | 600 | 1500 | 4000 | 9000 | 100 | 1600 | 13000 | 800 | 850 |
| 70° C. | 12050 | 2900 | 9800 | 15000 | 18000 | 1100 | 8800 | 22000 | 2500 | 2600 |
| Initial Noiseless Property | A | B | A | A | A | A | A | A | A | A |
| Initial Torque (gf · cm) | A | B | A | A | A | A | A | A | A | B |
| Durability | | | | | | | | | | |
| Duration for which Noiseless Property is Maintained (hour) | — | — | — | — | — | 1000 | — | — | >3000 | — |
| Dusting Characteristics at 70° C. (number/0.01 cf) | — | — | — | — | — | 125000 | — | — | 19000 | — |

TABLE 4

| | Comparative Example | | | | | | | | |
|---|---|---|---|---|---|---|---|---|---|
| | 11 | 12 | 13 | 14 | 15 | 16 | 17 | 18 | 19 |
| Thickener | | | | | | | | | |
| Lithium Stearate (A) (g) | 175 | 210 | 225 | 150 | 175 | 105 | 175 | 175 | 175 |
| Lithium 12-Hydroxy-stearate (B) (g) | 75 | 90 | 25 | 100 | 75 | 45 | 75 | 75 | 75 |
| Proportion (A:B) | 7:3 | 7:3 | 9:1 | 6:4 | 7:3 | 7:3 | 7:3 | 7:3 | 7:3 |
| Base Oil | | | | | | | | | |
| Ester Oil (g) | — | — | — | — | — | 300 | 260 | 410 | 260 |
| Poly-α-olefin (g) | — | — | 225 | 375 | 750 | 580 | 490 | — | 490 |
| Mineral Oil (g) | 750 | 700 | 525 | 375 | — | — | — | 340 | — |
| Ester Oil Content of Base Oil (%) | 0 | 0 | 0 | 0 | 0 | 35 | 35 | 55 | 35 |
| Thickener Content of Grease (%) | 25 | 30 | 25 | 25 | 25 | 15 | 25 | 25 | 25 |
| Viscosity of Base Oil ($mm^2$/sec, 40° C. | 100 | 29 | 30 | 30 | 180 | 70 | 70 | 20 | 70 |
| Initial Charateristics | | | | | | | | | |
| Unworked Penetration | 220 | 216 | 225 | 231 | 229 | 238 | 273 | 215 | 182 |
| Worked Penetration | 231 | 223 | 227 | 237 | 232 | 247 | 282 | 221 | 186 |
| Number of Splashing Particles having a Size of 0.3 μm or Larger (number/0.01 cf) | | | | | | | | | |
| 25° C. | 140 | 120 | 90 | 70 | 160 | 850 | 2100 | 900 | 550 |
| 70° C. | 1200 | 1050 | 850 | 800 | 1700 | 7800 | 9600 | 3050 | 1800 |
| Initial Noiseless Property | A | A | A | A | A | A | A | A | B |
| Initial Torque (gf · cm) | A | A | A | A | A | A | A | A | B |
| Durability | | | | | | | | | |
| Duration for which Noiseless Property is Maintained (hour) | 1500 | 1000 | 1500 | 1500 | 2000 | — | — | 2000 | — |
| Dusting Characteristics at 70° C. (number/0.01 cf) | 13000 | 15500 | 15000 | 16500 | 20000 | — | — | 23000 | — |

The grease composition of the present invention comprises 20 to 30% by weight of the thickener comprising a lithium soap of $C_{12}$–$C_{24}$ fatty acid containing no hydroxyl group and a lithium soap of $C_{12}$–$C_{24}$ fatty acid containing a hydroxyl group and the base oil having kinematic viscosity of 25 to 200 $mm^2$/sec, whereby the grease composition can maintain low initial splashing property and low initial noiseless property to such an extent that an operation of bearings is not disturbed. Further, the base oil of the present invention contains 10 to 70% by weight of an ester oil, whereby the grease composition undergoes improvements in lubricity, durability and heat resistance and can extremely reduce changes of splashing amount, noiseless property and durability with time, while maintaining the above-mentioned low initial properties.

Further, the thickener comprises 60 to 90% by weight of a lithium soap of $C_{12}$–$C_{24}$ fatty acid containing no hydroxyl group and 10 to 40% by weight of a lithium soap of $C_{12}$–$C_{24}$ fatty acid containing a hydroxyl group and the unworked penetration of the grease composition is adjusted to 190 to 250, whereby the grease composition of the present invention can more ensure the above-mentioned characteristics.

While the invention has been described in detail and with reference to specific examples thereof, it will be apparent to one skilled in the art that various changes and modifications can be made therein without departing from the spirit and scope thereof.

What is claimed is:

1. A grease composition comprising a base oil and a thickener, wherein said thickener comprises a lithium soap of $C_{12}$–$C_{24}$ fatty acid containing no hydroxyl group and a lithium soap of $C_{12}$–$C_{24}$ fatty acid containing a hydroxyl group said lithium soaps being in a proportion by weight of 60:40 to 90:10, and said base oil has kinematic viscosity of 25 to 200 $mm^2$/sec at 40° C. and contains 10 to 70% by weight of an ester oil, said grease composition containing the lithium soap of $C_{12}$–$C_{24}$ fatty acid containing no hydroxyl group and the lithium soap of $C_{12}$–$C_{24}$ fatty acid containing a hydroxyl group in a total amount of 20 to 30% by weight based on the grease composition.

2. The grease composition of claim 1, in which the unworked penetration is from 190 to 250.

* * * * *